US005182144A

United States Patent [19]

Hou

[11] Patent Number: 5,182,144

[45] Date of Patent: Jan. 26, 1993

[54] ORNAMENT ASSEMBLY

[75] Inventor: Jack Hou, Taipei, Taiwan

[73] Assignee: Giftec, Ltd., Taipei, Taiwan

[21] Appl. No.: 736,935

[22] Filed: Jul. 29, 1991

[51] Int. Cl.[5] ..... B44C 3/06

[52] U.S. Cl. ..... 428/16; D11/159; D21/70; 428/542.2

[58] Field of Search ..... 428/16, 7, 542.2, 542.4; 211/205; D21/249, 70; D11/159

[56] References Cited

U.S. PATENT DOCUMENTS

| | | | |
|---|---|---|---|
| D. 294,842 | 3/1988 | Hanson et al. | D11/159 X |
| 3,308,705 | 3/1967 | Shinnick | 428/7 X |
| 4,050,342 | 9/1977 | Suzuki et al. | 428/16 X |
| 4,390,099 | 6/1983 | Trautlein et al. | 211/205 X |
| 4,525,393 | 6/1985 | Di Costanzo | 428/7 |
| 4,890,828 | 1/1990 | Hou | 272/31 R |
| 4,925,182 | 5/1990 | Hou | 272/31 R |
| 4,995,845 | 2/1991 | Hou | 428/16 X |
| 5,006,416 | 4/1991 | Hou | 428/16 X |

*Primary Examiner*—Henry F. Epstein
*Attorney, Agent, or Firm*—Bacon & Thomas

[57] ABSTRACT

A decorative figure is supported on a tappet rod extending vertically from a base member, with a support ring being provided at the upper end of the rod. The figure may be displayed by either placing the base member on a horizontal support surface for using the ring to suspend the assembly from an overhead support, such as a branch of a Christmas tree. The base member may also be provided with a recess for receiving a battery powered IC unit to produce electronically generated music.

7 Claims, 1 Drawing Sheet

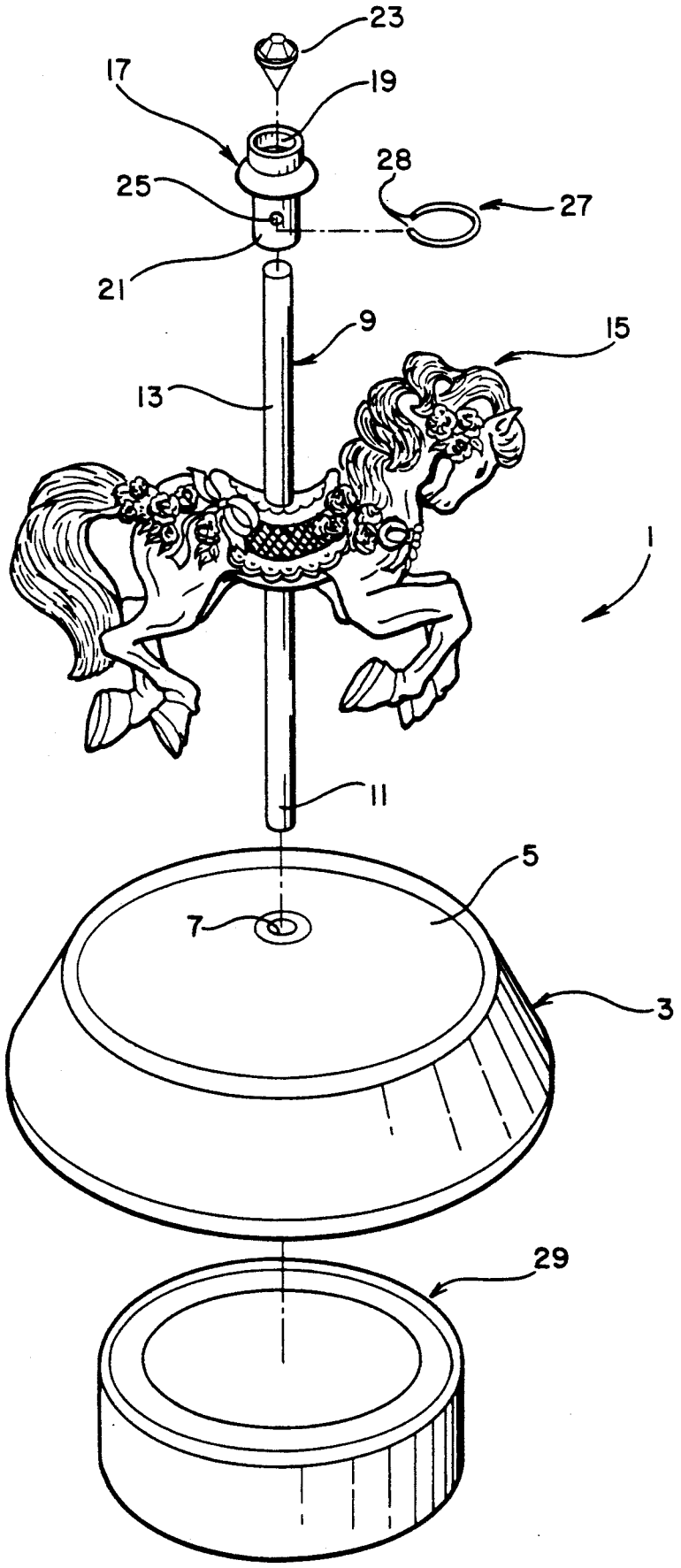
23
17
19
28
25
27
21
9
15
13
1
11
5
7
3
29

ORNAMENT ASSEMBLY

BACKGROUND OF THE INVENTION

1. Field of the Invention

The present invention generally involves the field of technology pertaining to giftware in the form of decorative objects. More specifically, the invention relates to an improved structure for an ornament assembly wherein a decorative figure may be displayed in different ways.

2. Description of the Prior Art

It is known to provide an ornament assembly wherein a decorative figure is supported on a rod extending upwardly from a base member so that the figure may be displayed when the base member is placed on a suitable support surface, such as a table or shelf. The figure to be displayed may be formed of plastic, ceramic or other suitable materials which can be cast or molded into the desired shape. Conventional assemblies of this type are usually of complex structure and expensive to manufacture, thereby limiting their applications to costly giftware or collector items. Moreover, such assemblies are normally limited to a specific manner of display, such as supporting the assembly on a horizontal surface.

BRIEF SUMMARY OF THE INVENTION

It is an object of the invention to provide an improved ornament assembly which is versatile in use.

It is another object of the invention to provide an improved ornament assembly which has a high quality appearance and is economical to manufacture.

It is a further object of the invention to provide an improved ornament assembly which includes musical accompaniment for a decorative figure being displayed by the assembly.

These and other objects of the invention are realized by providing an improved ornament assembly which is primarily comprised of a base member having a base socket formed in its upper surface for engagement by the lower end of a tappet rod. A decorative figure is supported on the rod for display. The upper end of the rod is provided with a double-ended socket member for receiving an ornament and a support ring. The base member may include a recess in its bottom portion for receiving a conventional battery powered IC unit to produce electronically generated musical accompaniment for the figure being displayed. The figure may be displayed by either placing the base member on a horizontal support surface or hanging the assembly by the support ring from an overhead support.

Other objects, features and advantages of the invention shall become apparent from the following detailed description of preferred embodiments thereof, when taken in conjunction with the single sheet of drawing.

BRIEF DESCRIPTION OF THE DRAWING

The single sheet of drawing is an exploded perspective view showing an ornament assembly according to a preferred embodiment of the invention.

DETAILED DESCRIPTION OF THE PREFERRED EMBODIMENTS

With reference to the drawing, there is shown an ornament assembly 1 according to a preferred embodiment of the invention. Assembly 1 includes a base member 3, preferably of circular configuration. An upper surface 5 of base member 3 is provided with a central socket 7 formed therein, with socket 7 being also preferably of circular configuration. Base member 3 may be formed from any suitable material, but is preferably integrally molded of plastic.

An elongate tappet rod 9, preferably of cylindrical configuration, includes a lower end 11 and an upper end 13. Rod 9 is preferably formed of metal and provided with a decorative outer surface, such as a surface having a longitudinally extending circumferential spiral configuration. A decorative FIG. 15 is supported on rod 9. This may be realized by providing a cylindrical passageway in FIG. 15 and extending rod 9 therethrough, whereby rod 9 may be frictionally or adhesively secured to FIG. 15. Alternatively, if FIG. 15 is molded of plastic material, it may be advantageous to directly mold FIG. 15 onto rod 9 during the molding process. FIG. 15 may be supported substantially midway between ends 11 and 13 of rod 9 for display. FIG. 15 may be supported substantially midway between ends 11 and 13 of rod 9 for display.

Lower end 11 of rod 9 is inserted within socket 7 for attaching rod 9 to base member 3 so that rod 9 extends vertically upwardly from upper surface 5. This is advantageously realized by sizing aperture 7 relative to the diameter of bottom end 11 so that the latter may be frictionally engaged within socket 7, thereby easily and securely attaching rod 9 to base member 3. Alternatively, bottom end 11 may be adhesively secured within socket 7 or integrally molded therein during the molding of base member 3. Moreover, bottom end 11 may also be threaded for engagement within a corresponding internally threaded socket 7. These alternative means of attaching tappet rod 9 to base member 3 are all realized in a simple and direct manner and, more importantly, do not require the use of any separate mechanical fastening means.

Upper end 13 of tappet rod 9 is provided with a double socket member 17 having an upwardly extending cylindrical socket 19 and a downwardly extending cylindrical socket 21. Socket member 17 is preferably integrally molded of plastic material, with the inner diameter of socket 21 being sized to frictionally receive upper end 13 of tappet rod 9 therein. A decorative ornament 23, such as a glass or plastic jewel, may be secured within socket 19. A pair of holes 25 are formed in opposed exterior wall portions of socket 21. A support ring 27, preferably formed of metal or similar resilient material, is of a C-shaped configuration and provided with a pair of opposed inwardly directed ends 28 which are snap-fitted into opposed holes 25 of socket 21. In this manner, ring 27 is pivotally secured to socket 21 and may be pivoted to a vertical position for attachment to an overhead support, such as a Christmas tree branch, hook or other such support means.

Base member 3 may also preferably be provided with a recess in its bottom portion for receiving a music-producing unit 29. Unit 29 is preferably a conventional IC or integrated circuit assembly having a battery and a manual actuation switch for electronically producing one or more pre-programmed musical scores for accompanying the display of FIG. 15 by assembly 1. For example, if assembly 1 is to be used as a Christmas tree ornament, unit 29 may be programmed to play well-known Christmas carols. Since assembly 1 may also be advantageously displayed on a horizontal surface, the recess within base member 3 should be configured and sized to receive unit 29 therein so that the latter is at least flush with or recessed below the bottom surface of member 3.

It is therefore apparent that the present invention provides an improved ornament assembly 1 formed of parts which may be economically manufactured and easily assembled in large quantities, while maintaining a high quality product appearance. The nature of assembly 1 permits it to be either suspended from an overhead support or placed on a horizontal surface, thereby rendering assembly 1 versatile in use for displaying ornamental FIG. 15 to its best advantage.

It is to be understood that the forms of the invention herein shown and described are to be taken as preferred embodiments thereof, and that various changes in shape, material, size and arrangement of parts may be resorted to without departing from the spirit of the invention or scope of the subjoined claims.

I claim:

1. An ornament assembly comprising:

a) a base member for supporting the assembly on a horizontal surface, the base member including an upper surface having a base socket formed therein;

b) an elongate tappet rod having an upper end and a lower end, the lower end of the rod being secured within the base socket so that the rod extends vertically from the upper surface of the base member; and c) a socket member including a downwardly extending socket, with the upper end of the tappet rod being engaged within the downwardly extending socket, and an upwardly extending socket for receiving a decorative ornament.

2. The ornament assembly of claim 1 wherein the downwardly extending socket is partially defined by opposed wall portions, a pair of holes formed in the wall portions, and a support ring secured within the holes for suspending the assembly from an overhead support.

3. The ornament assembly of claim 2 wherein the support ring is of a substantially C-shaped configuration and provided with a pair of opposed inwardly directed ends, and the ends being secured within the holes of the socket.

4. The ornament assembly of claim 1 wherein:

a) the base member includes a bottom recess; and b) a music-producing IC unit disposed within the bottom recess.

5. The ornament assembly of claim 1 wherein the bottom end of the tappet rod is secured within the rod socket in the absence of any mechanical fastening means.

6. The ornament assembly of claim 1 wherein the bottom end of the tappet rod is frictionally secured within the rod socket.

7. The ornament assembly of claim 1 further including a decorative figure secured to the tappet rod.

* * * * *